US011649974B2

(12) United States Patent
Zhou

(10) Patent No.: US 11,649,974 B2
(45) Date of Patent: May 16, 2023

(54) PRE-COOLING DEVICE DEHUMIDIFIER

(71) Applicant: NINGBO REFINE MOULD TECHNOLOGY CO., LTD, Zhejiang (CN)

(72) Inventor: Rui Zhou, Zhejiang (CN)

(73) Assignee: NINGBO REFINE MOULD TECHNOLOGY CO., LTD, Zhejiang (CN)

( * ) Notice: Subject to any disclaimer, the term of this patent is extended or adjusted under 35 U.S.C. 154(b) by 219 days.

(21) Appl. No.: 16/910,452

(22) Filed: Jun. 24, 2020

(65) Prior Publication Data

US 2021/0055009 A1 Feb. 25, 2021

(30) Foreign Application Priority Data

Aug. 20, 2019 (CN) ..... 201910769197.8

(51) Int. Cl.
*F24F 3/14* (2006.01)
*F24F 3/153* (2006.01)
*F25B 40/02* (2006.01)

(52) U.S. Cl.
CPC ..... *F24F 3/1405* (2013.01); *F24F 3/153* (2013.01); *F25B 40/02* (2013.01); *F24F 2003/1446* (2013.01)

(58) Field of Classification Search
CPC .. F24F 3/1405; F24F 3/14; F24F 3/153; F24F 3/147; F24F 2003/1446; F24F 2003/144; F25B 40/02; F25B 2400/0409; F25B 2400/0411; F25B 2400/0417; F25B 2313/0234; F25B 2313/02341; F25B 2313/02343
See application file for complete search history.

(56) References Cited

U.S. PATENT DOCUMENTS 4,811,568 A * 3/1989 Horan ..... F25B 5/02 62/200
RE36,408 E * 11/1999 Yamanaka ..... F25B 40/02 62/509
2002/0148239 A1* 10/2002 Trieskey ..... F25B 5/02 62/201
2016/0348840 A1* 12/2016 Nagura ..... F04B 41/02
2018/0266709 A1* 9/2018 Tucker ..... F25B 40/02

* cited by examiner

*Primary Examiner* — Tavia Sullens
(74) *Attorney, Agent, or Firm* — Tarolli, Sundheim, Covell & Tummino LLP

(57) ABSTRACT

A dehumidifier with a pre-cooling device includes a compressor, a condenser, an expansion device, a microchannel pre-cooler and an evaporator assembly. During operation, moist air enters from an air inlet of the dehumidifier, and passes through the microchannel pre-cooler to make the moist air to reach a saturated steam state and passes through the evaporator assembly for heat exchange to condense and dehumidify the moist air, and the dehumidified air passes through the condenser for heating and finally discharged from the air outlet, so that the water vapor in the moist air can be condensed into a liquid better to improve the condensation and dehumidification effects of the evaporator and reduce the air humidity effectively, so as to improve the dehumidification effect of the equipment.

8 Claims, 3 Drawing Sheets

PRE-COOLING DEVICE DEHUMIDIFIER

RELATED APPLICATIONS

The present invention is a Nonprovisional Application under 35 USC 111(a), claiming priority to Serial No. CN 201910769197.8, filed on 20 Aug. 2019, the entirety of which is incorporated herein by reference.

FIELD OF THE INVENTION

The present invention relates to the field of dehumidifiers, and more particularly to a dehumidifier with a pre-cooling device.

BACKGROUND OF THE INVENTION

Dehumidifier (also known as humidity extractor, dryer, and moisture remover) is mainly divided into two types: household dehumidifier and industrial dehumidifier, and the dehumidifier is a member of the air-conditioning family. The operating principle of the dehumidifier is to draw moist air into the machine and pass the air through a heat exchanger. Now, the water vapor in the air is condensed into water-drops, and the processed dry air is discharged from the machine to the outside, and this cycle keeps the indoor humidity at an appropriate relative humidity.

In reality, the moist air reaching a saturated steam state and passing through an evaporator has the best condensation and dehumidification effects. However, the conventional dehumidifiers generally fail to make the moist air to reach the saturated steam state before entering into the evaporator for heat exchange, and the water vapor passing through the evaporator cannot be condensed into liquid very well, so that the condensation and dehumidification effects of the evaporator is reduced, and the dehumidification effect of the dehumidifier is poor. The present invention discloses a dehumidifier with a microchannel pre-cooler to overcome the aforementioned drawback of the conventional dehumidifier, and the microchannel pre-cooler can make the moist air to reach the saturated steam state before entering into the evaporator, so that the water vapor in the moist air reaching the saturated steam state during the heat exchange process can be condensed into liquid very well to improve the condensation and dehumidification effects of the evaporator and reduce the air humidity effectively, so as to improve the dehumidification effect of the equipment.

SUMMARY OF THE INVENTION

In view of the aforementioned drawbacks and the poor dehumidification effect of the conventional dehumidifier, it is a primary objective of the present invention to provide a dehumidifier with a pre-cooling device to overcome the drawbacks of the prior art that the moist air cannot reach the saturated steam state before entering into the heat exchange process of the evaporator, and the present invention has a microchannel pre-cooler provided for the moist air to enter into the saturated steam state before entering into the evaporator, and the moist air is cooled to reach the saturated steam state during the heat exchange process, so that the water vapor in the moist air can be condensed into liquid very well to improve the condensation and dehumidification effects of the evaporator and reduce the air humidity effectively, so as to improve the dehumidification effect of the equipment.

To achieve the aforementioned and other objectives, the present invention discloses a dehumidifier with a pre-cooling device comprising: a compressor, a condenser, an expansion mechanism, a microchannel pre-cooler and an evaporator assembly, characterized in that moist air enters from an air inlet formed on a casing of the dehumidifier, and passes through the microchannel pre-cooler to make moist air to reach a saturated steam state, and further passes through the evaporator assembly to perform heat exchange in order to condense and dehumidify the moist air, and the dehumidified air passes through the condenser for heating, and finally discharged from the air outlet, wherein a refrigerant used in the condenser, the expansion mechanism, the microchannel pre-cooler, and the evaporator assembly is delivered by a pipeline, and a refrigeration cycle is completed by the compressor.

Further, a throttling capillary is installed between the microchannel pre-cooler and the evaporation mechanism for changing a cold fluid refrigerant into a cold liquid refrigerant.

Further, the dehumidifier comprises an expansion device and an auxiliary expansion device, and a hot liquid refrigerant passing through the condenser flows into the expansion device and the auxiliary expansion device separately.

Further, the hot liquid refrigerant flowing out from the condenser passes through the expansion device to expand the volume and reduce the temperature and pressure of the refrigerant before entering into the microchannel pre-cooler.

Further, the hot liquid refrigerant flowing out from the condenser passes through the auxiliary expansion device to expand the volume and reduce temperature and pressure of the refrigerant before entering into the subcooler.

Further, the subcooler receives a cold liquid refrigerant from the auxiliary expansion device and evaporates the cold liquid refrigerant to form a cold gas refrigerant.

Further, the cold gas refrigerant produced by the evaporator assembly and the subcooler reaching a confluence and passing through the compressor becomes a hot gas refrigerant, and then the compressor delivers the hot gas refrigerant to the condenser to complete a refrigeration cycle.

Further, the evaporator assembly has one or two evaporators.

Compared with the prior art, this invention has the following advantages and effects: This invention has a microchannel pre-cooler, so that the moist air can reach the saturated steam state before entering into the evaporator, and the water vapor in the moist air reaching the saturated steam state before entering into the heat exchange can be condensed into liquid very well to improve the condensation and dehumidification of the evaporator and reduce the air humidity, so as to improve the dehumidification effect of the equipment.

The technical characteristics of the present invention will become apparent with the detailed description of preferred embodiments accompanied with the illustration of related drawings as follows.

BRIEF DESCRIPTION OF NUMERALS USED IN THE DRAWINGS

1: Casing; 2: Microchannel pre-cooler; 3: Evaporator assembly; 31: First evaporator: 32: Second evaporator: 4:

Condenser: 5: Compressor: 6: Auxiliary expansion device: 7: Throttling capillary: 8: Expansion device; 9: Subcooler.

DESCRIPTION OF THE PREFERRED EMBODIMENTS

Figure 1:
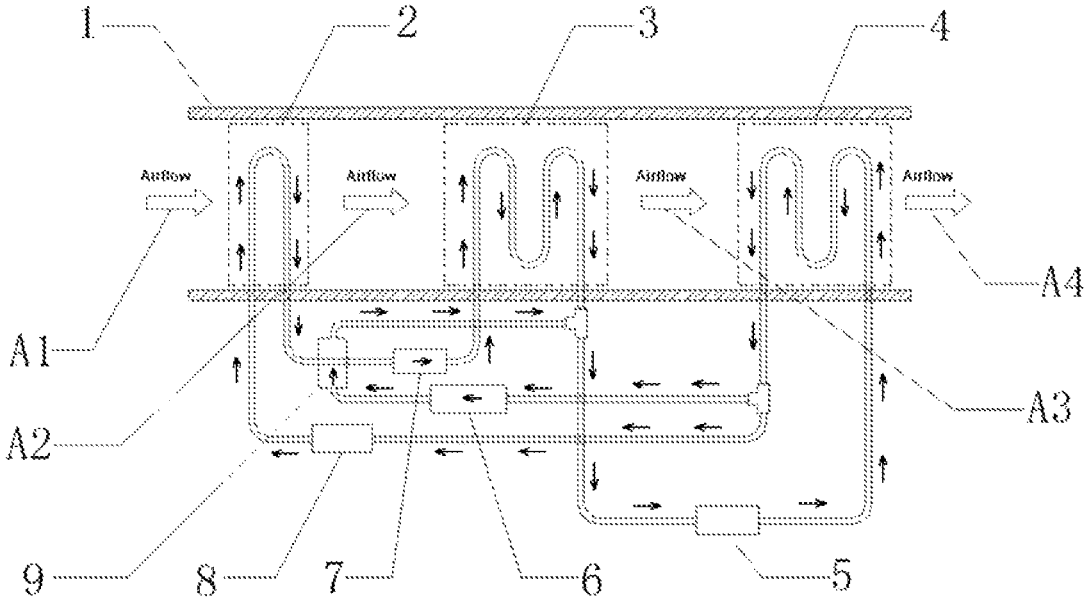
FIG. 1 is a schematic view of a first embodiment of the present invention.
Figure 5:
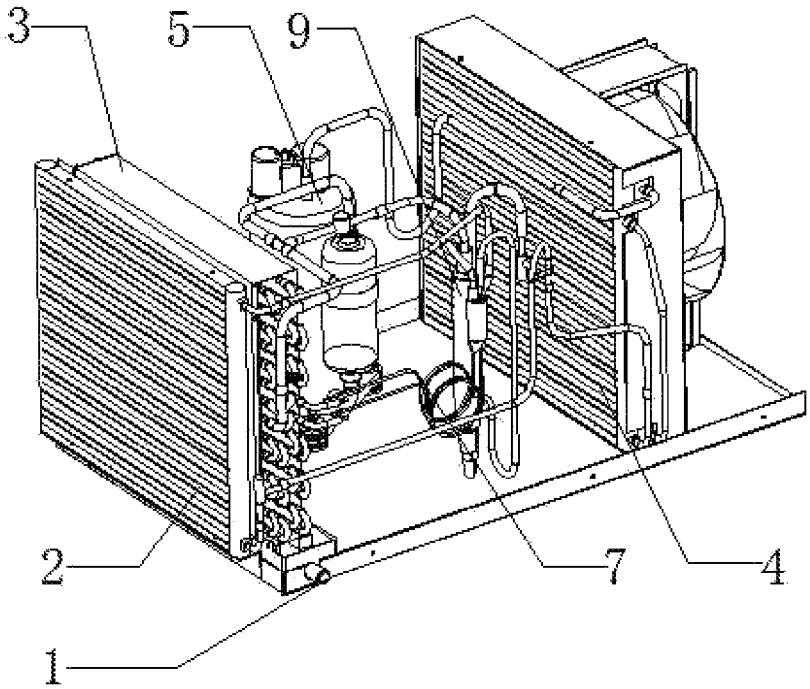
FIG. 5 is a perspective view of the present invention.

With reference to FIG. 1 and FIG. 5 for a dehumidifier with a pre-cooling device in accordance with the first embodiment of the present invention, the dehumidifier comprises a casing 1, a microchannel pre-cooling device 2, an evaporator assembly 3, a condenser 4, and an expansion mechanism, wherein the refrigerant used in the microchannel pre-cooling device 2, evaporator assembly 3, condenser 4, and expansion mechanism are delivered by a pipeline, and the compressor 5 is provided for completing a refrigeration cycle.

During the cycle, the compressor 5 sends a hot gas refrigerant to the condenser 4 to be processed by a heat exchange of the condenser 4 and then the hot liquid refrigerant flows out from the condenser 4 and into the expansion mechanism, wherein the expansion mechanism comprises an expansion device 8 and an auxiliary expansion device 6. After the flow the hot gas refrigerant is divided, a part of the hot liquid refrigerant passing through the expansion device 8 is expanded to reduce the temperature and pressure of the refrigerant and entered into the microchannel pre-cooler 2, and the other part of the hot liquid refrigerant is passed through the auxiliary expansion device 6 and expanded to reduce the temperature and pressure of the refrigerant and entered into the subcooler 9.

Further, a throttling capillary 7 is installed between the microchannel pre-cooler 2 and the evaporation mechanism 3 and provided for changing a cold fluid refrigerant flowing out from the microchannel pre-cooler 2 into a cold liquid refrigerant, and the cold liquid refrigerant is passed into the evaporation mechanism 3 for a heat exchange. After the heat exchange is completed, the cold liquid refrigerant is changed into cold air refrigerant which flows out from the evaporation mechanism 3.

Further, the subcooler 9 receives a cold liquid refrigerant from the auxiliary expansion device 6, and evaporates the cold liquid refrigerant to form a cold gas refrigerant, and the cold gas refrigerant flowing out from the evaporation mechanism 3 and the cold gas refrigerant flowing out from the subcooler 9 are combined and the combined cold gas refrigerant flows towards the compressor 5.

Further, the cold gas refrigerant produced by the evaporation mechanism 3 and the subcooler 9 is passed through the compressor 5 and changed into a hot gas refrigerant, and then the compressor 5 delivers the hot gas refrigerant into the condenser 4 to complete a refrigeration cycle.

Figure 4:
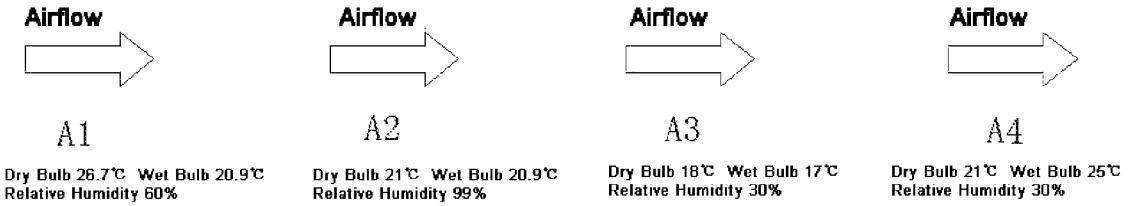
FIG. 4 is a schematic view showing the status of airflow during the operation of the present invention.

During the operation of the dehumidifier, referring to FIG. 4, an airflow A1 entering from an air inlet formed on the casing 1 passes through the microchannel pre-cooler 2 to make the moist air to reach a saturated steam state, and the water vapor of the airflow A2 reaching the saturated steam state in the heat exchange process of the evaporation mechanism 3 can be condensed into liquid very well to improve the condensation and dehumidification of the evaporator effectively, and the dehumidified airflow A3 is heated by the condenser 4 and finally the airflow A4 is discharged from the air outlet.

Figure 2:
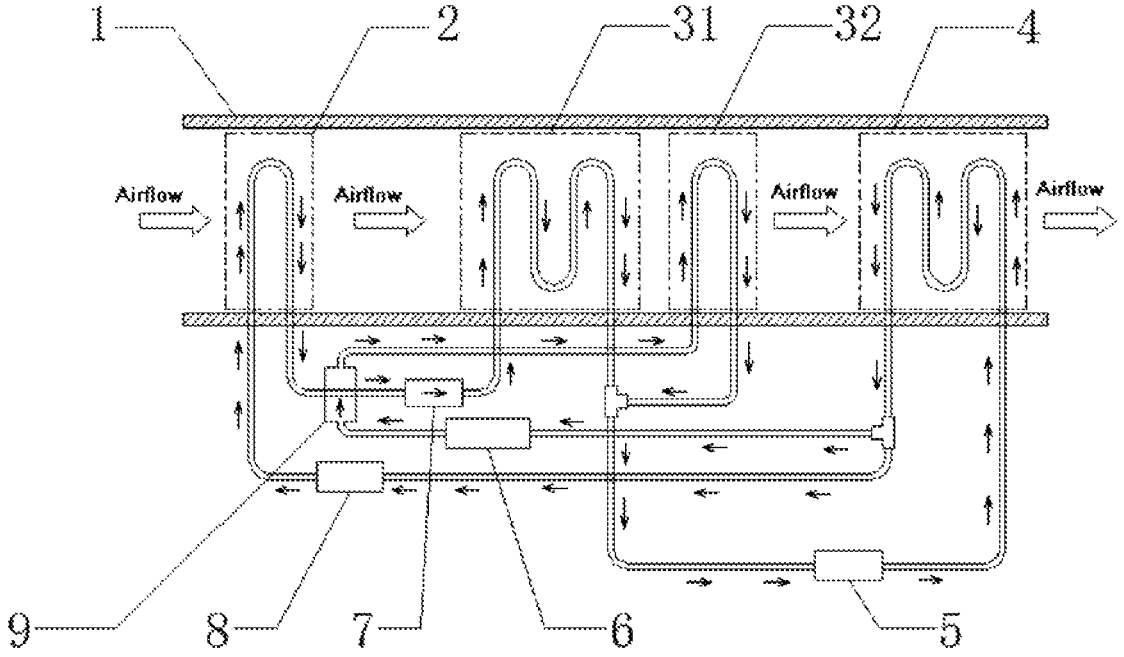
FIG. 2 is a schematic view of a second embodiment of the present invention.

With reference to FIG. 2 and FIG. 5 for a dehumidifier with a pre-cooling device in accordance with the second embodiment of the present invention, the dehumidifier is based on the first embodiment, and the evaporation mechanism 3 of the second embodiment has two evaporators: a first evaporator 31 and a second evaporator 32 respectively, wherein the cold gas refrigerant flowing out from the subcooler 9 enters into the second evaporator 32 for a heat exchange, and the cold gas refrigerants flowing out from the first evaporator 31 and the second evaporator 32 are combined and entered into the compressor 5 to complete a refrigeration cycle. In the second embodiment 2, the evaporation mechanism 3 has two evaporators, so that when the airflow A2 passes through the evaporation mechanism 3, the condensation and dehumidification can be carried out sufficiently to obtain an airflow A4 having a lower relative humidity to improve the dehumidification effect of the equipment.

Figure 3:
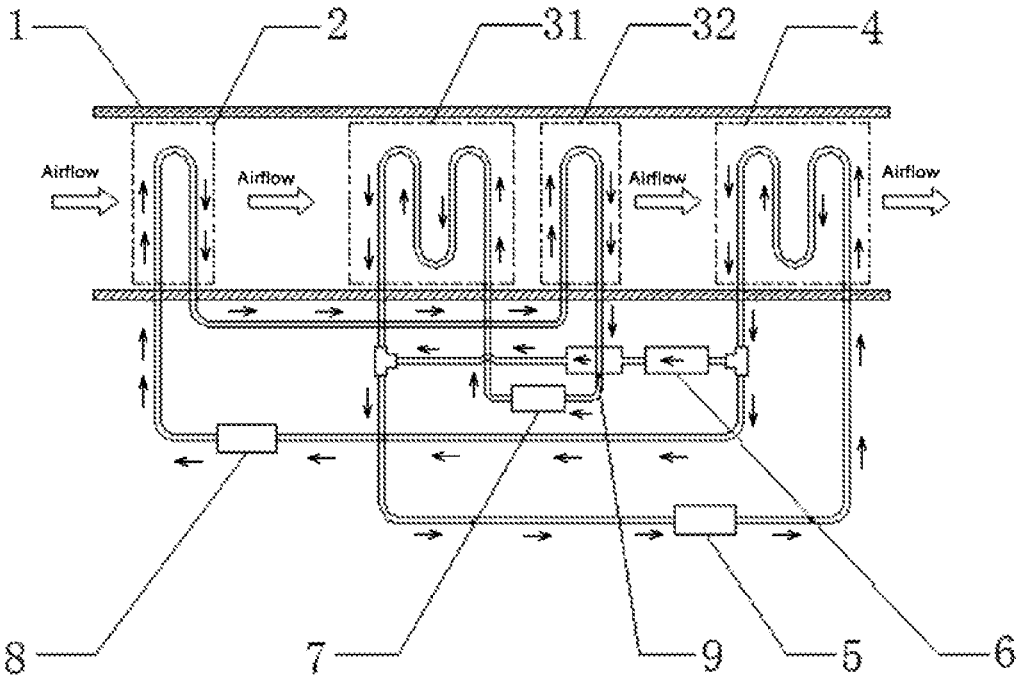
FIG. 3 is a schematic view of a third embodiment of the present invention.

With reference to FIG. 3 and FIG. 5 for a dehumidifier with a pre-cooling device in accordance with the second embodiment of the present invention, the dehumidifier is based on the second embodiment, and the evaporation mechanism 3 also has two evaporators: a first evaporator 31 and a second evaporator 32 respectively, and a throttling capillary 7 is installed between the first evaporator 31 and the second evaporator 32, and a cold fluid refrigerant flowing out from the microchannel pre-cooler flows into the second evaporator 32 for a heat exchange, and the refrigerant flowing out from the throttling capillary 7 after the heat exchange process enters into the first evaporator 31, wherein the cold gas refrigerant flowing out from the subcooler 9 and the cold gas refrigerant flowing out from the first evaporator 31 are combined and entered into the compressor 5 to complete a refrigeration cycle.

This invention has a microchannel pre-cooler to make the moist air to reach the saturated steam state before entering into the evaporator, and the water vapor in the moist air reaching the saturated steam state in the heat exchange process conducted by the evaporator can be condensed into liquid very well to improve the condensation and dehumidification effects of the evaporator and reduce the air humidity effectively, so as to improve the dehumidification effect of the equipment. Since there are two evaporators of the evaporation mechanism in the second embodiment, therefore the moist air can be condensed and dehumidified very well to obtain air with a low relative humidity and improve the dehumidification effect of the equipment.

While the invention has been described by means of specific embodiments, numerous modifications and variations could be made thereto by those skilled in the art without departing from the scope and spirit of the invention as set forth in the claims.

What is claimed is:

1. A dehumidifier with a pre-cooling device, the dehumidifier comprising:

a compressor configured to complete a refrigeration cycle;

a condenser;

an expansion device;

an auxiliary expansion device;

a microchannel pre-cooler;

an evaporator assembly;

a pipeline configured to deliver a refrigerant used in the condenser, the expansion device, the auxiliary expansion device, the microchannel pre-cooler, and the evaporator assembly; and a casing comprising an air inlet and an air outlet, wherein the dehumidifier is configured to:

admit moist air from the air inlet, pass the moist air through the microchannel pre-cooler such that the moist air reaches a saturated steam state and becomes saturated steam state air, pass the saturated steam state air through the evaporator assembly to perform heat exchange in order to condense and dehumidify the saturated steam state air to create dehumidified air, pass the dehumidified air through the condenser for heating to create heated dehumidified air, and discharge the heated dehumidified air from the air outlet, and wherein when taking the compressor as a starting point of the refrigeration cycle, the dehumidifier is configured such that:

the refrigerant flowing out from the compressor passes through the condenser and then a first portion of the refrigerant flows into the expansion device and a second portion of the refrigerant flows into the auxiliary expansion device separately;

the first portion of the refrigerant flowing out from the expansion device then flows through the microchannel pre-cooler and the evaporator assembly in sequence; and the second portion of the refrigerant flowing out from the auxiliary expansion device and the first portion of the refrigerant flowing out from the evaporator assembly reach a confluence and then the confluence flows into the compressor.

2. The dehumidifier of claim 1, wherein the evaporator assembly has one or two evaporators.

3. The dehumidifier of claim 1, further comprising a throttling capillary between the microchannel pre-cooler and the evaporator assembly and configured to change the first portion of the refrigerant, which is a cold fluid refrigerant, into a cold liquid refrigerant.

4. The dehumidifier of claim 1, wherein the refrigerant passing through the condenser into the expansion device and the auxiliary expansion device separately is a hot liquid refrigerant.

5. The dehumidifier of claim 4, wherein the expansion device is configured to expand the volume and reduce the temperature and pressure of the first portion of the refrigerant before the first portion of the refrigerant enters into the microchannel pre-cooler.

6. The dehumidifier of claim 4, further comprising a subcooler between the auxiliary expansion device and the evaporator assembly, and wherein the auxiliary expansion device is configured to expand the volume and reduce temperature and pressure of the second portion of the refrigerant before the second portion of the refrigerant enters into the subcooler.

7. The dehumidifier of claim 6, wherein the second portion of the refrigerant flowing out from the auxiliary expansion device is a cold liquid refrigerant, and the subcooler is configured to receive cold liquid refrigerant from the auxiliary expansion device and to evaporate the cold liquid refrigerant to form a cold gas refrigerant.

8. The dehumidifier of claim 7, wherein the confluence passes through the compressor, and becomes a hot gas refrigerant, and wherein the compressor is configured to deliver the hot gas refrigerant to the condenser to complete the refrigeration cycle.

* * * * *